US010894651B2

(12) United States Patent
Cooke et al.

(10) Patent No.: US 10,894,651 B2
(45) Date of Patent: Jan. 19, 2021

(54) BOX INCLUDING CAPSULES AND METHOD OF SENDING CAPSULES

(71) Applicant: Conopco, Inc., Englewood Cliffs, NJ (US)

(72) Inventors: Deborah Jane Cooke, Chester (GB); Andrew David Green, Dobshill (GB); Matthew Charles Meyrick Pritchard, Reading (GB); Neil John Smith, Liverpool (GB)

(73) Assignee: Conopco, Inc., Englewood Cliffs, NJ (US)

( * ) Notice: Subject to any disclaimer, the term of this patent is extended or adjusted under 35 U.S.C. 154(b) by 100 days.

(21) Appl. No.: 16/300,666

(22) PCT Filed: May 12, 2017

(86) PCT No.: PCT/EP2017/061477

§ 371 (c)(1),
(2) Date: Nov. 12, 2018

(87) PCT Pub. No.: WO2017/198564

PCT Pub. Date: Nov. 23, 2017

(65) Prior Publication Data

US 2019/0152670 A1 May 23, 2019

(30) Foreign Application Priority Data

May 17, 2016 (EP) ..... 16169837

(51) Int. Cl.
*B65D 77/04* (2006.01)
*B65D 65/46* (2006.01)
*C11D 11/00* (2006.01)
*C11D 17/04* (2006.01)

(52) U.S. Cl.
CPC ..... *B65D 77/0413* (2013.01); *B65D 65/46* (2013.01); *C11D 11/0017* (2013.01); *C11D 17/042* (2013.01)

(58) Field of Classification Search
CPC .. B65D 65/46; B65D 77/0413; C11D 17/042; C11D 11/0017
See application file for complete search history.

(56) References Cited

U.S. PATENT DOCUMENTS

| | | | |
|---|---|---|---|
| 5,806,680 | A | 9/1998 | Barthel et al. |
| 7,703,631 | B2 | 4/2010 | Chafe et al. |
| 2003/0234252 | A1 | 12/2003 | Howard |

(Continued)

FOREIGN PATENT DOCUMENTS

| | | |
|---|---|---|
| CN | 1409682 | 4/2003 |
| CN | 2730794 | 10/2005 |

(Continued)

OTHER PUBLICATIONS

Co-pending application filed Nov. 12, 2018.

(Continued)

*Primary Examiner* — Stephen J Castellano
(74) *Attorney, Agent, or Firm* — Greenberg Traurig, LLP

(57) ABSTRACT

A box (51) containing a two dimensional array of laundry detergent capsules (21) containing laundry detergent composition, the box having a height of no more than 3.5 cm and a method of sending such a box to a consumer using a postal service.

8 Claims, 2 Drawing Sheets

(56) References Cited

U.S. PATENT DOCUMENTS

| | | | | |
|---|---|---|---|---|
| 2009/0110723 | A1 | 4/2009 | McAllister | |
| 2011/0195231 | A1* | 8/2011 | Lai | B32B 29/08 428/186 |
| 2012/0090475 | A1* | 4/2012 | Deuber | A47J 31/3695 99/295 |

FOREIGN PATENT DOCUMENTS

| | | |
|---|---|---|
| CN | 1968829 | 5/2007 |
| CN | 201309670 | 9/2009 |
| CN | 101827571 | 9/2010 |
| CN | 103153813 | 6/2013 |
| DE | 19537671 | 4/1997 |
| DE | 102014206095 | 10/2015 |
| EP | 0947443 | 10/1999 |
| EP | 2463435 | 3/2010 |
| GB | 539891 | 9/1941 |
| GB | 2013235 | 8/1979 |
| GB | 2375517 | 11/2002 |
| GB | 2375542 | 11/2002 |
| GB | 2401848 | 11/2004 |
| JP | 8119370 | 5/1996 |
| WO | WO0136290 | 5/2001 |
| WO | WO2004005156 | 1/2004 |

OTHER PUBLICATIONS

Search Report and Written Opinion in PCTEP2017061477; dated Jul. 13, 2017.

Search Report and Written Opinion in EP16169837; dated Jan. 12, 2017.

Search Report and Written Opinion in PCTEP2017061491; dated Jun. 23, 2017.

Search Report and Written Opinion in EP16169839; dated Nov. 8, 2016.

* cited by examiner

BOX INCLUDING CAPSULES AND METHOD OF SENDING CAPSULES

This application is the national stage (Rule 371) of international application No. PCT/EP2017/061477 filed May 12, 2017.

FIELD OF INVENTION

The present invention relates to laundry detergent capsules encasing a laundry detergent composition for arranging in a packaged array, a two dimensional array of the capsules and packaging containing the two dimensional array of the capsules.

BACKGROUND

Laundry detergent capsules are typically bought by a consumer in a shop (or store). The capsules are typically packaged in high wall containers to assist stacking and storage in the warehouse, shop and the consumer's residence.

SUMMARY OF INVENTION

The present inventors have realised that laundry detergent containers containing laundry detergent capsules are not suitable for consumers who wish to receive laundry detergent capsules without visiting a shop.

At its most general, the present invention provides a capsule encasing a detergent composition, such as a laundry detergent composition, wherein the capsule is adapted to be arranged in a packaged two dimensional array of capsules in order to fit through a mail slot. The present invention also provides a deliverable box containing a two dimensional array of laundry detergent capsules containing laundry detergent composition.

In a first aspect, the present invention provides a laundry detergent capsule containing a laundry detergent composition, the capsule having a substantially planar lid and a substantially planar base, the capsule having a height in the range of 1.5 and 2.5 cm and the capsule lid or capsule base having a lateral dimension in the range of 3.0 and 5.0 cm.

The capsules therefore are adapted to be packaged in a two dimensional array that is suitable to be sent by mail and be delivered through a conventional mail slot.

As described herein, "substantially planar" means generally extending in one plane. The height of the capsule as defined herein is the maximum vertical straight line distance from the lid to the base of the capsule. The lateral dimension may be width, depth, diameter or width along a major axis (e.g. for elliptical cross-sections).

In a second aspect, the present invention provides a box including a two dimensional array of laundry detergent capsules containing laundry detergent composition, the box having a height of no more than 3.5 cm.

In a third aspect, the present invention provides a method of sending laundry detergent capsules to a user wherein the method includes sending a box to a user by a postal service, the box including a two dimensional array of laundry detergent capsules containing laundry detergent composition, the box having a height of no more than 3.5 cm.

DETAILED DESCRIPTION

The present invention will now be described in more detail and with reference to the accompanying Figures.

GENERAL CAPSULE STRUCTURE

Figure 1A:
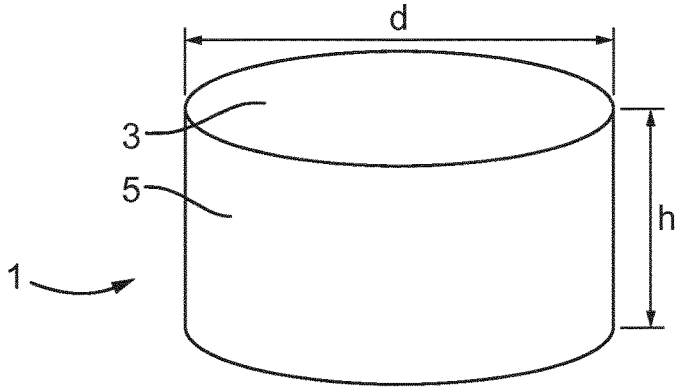
FIG. 1 shows perspective views of three capsule shapes: a cylindrical capsule (FIG. 1*a*); a cuboid capsule (FIG. 1*b*); and a rounded cuboid capsule (FIG. 1*c*).

The laundry detergent capsule of the present invention typically includes a capsule base, one or more side walls extending from the base and a sealed with a capsule lid. The capsule lid is typically connected to an upper end of capsule side wall or side walls and the base is typically connected to a lower end of the capsule side wall or side walls. In this way, the internal surfaces of the capsule base, capsule lid and side wall or side walls can form a capsule cavity accommodating the laundry detergent composition.

The laundry detergent capsule may be any three-dimensional shape that forms a satisfactory capsule for holding a laundry detergent composition. Examples of shapes of capsules include, but are not limited to, truncated spherical, cylindrical (circular or elliptical), truncated conical (circular or elliptical), cube, cuboid, triangular prism, pentagonal prism, hexagonal prism or derivatives thereof. Certain shapes typically have a single side wall (such as truncated spherical, cylindrical and truncated conical), while others typically have more than one side wall (such as cube, cuboid, triangular prism, pentagonal prism, hexagonal prism).

The capsule of the present invention may be formed of two parts, a laundry detergent enclosure and the capsule lid, where the laundry detergent enclosure includes the capsule base and the capsule side walls extending generally upwardly from the base to form a cavity in which the laundry detergent composition can be housed. The laundry detergent enclosure typically has an enclosure aperture created by the upper rim of the capsule side wall or side walls. The laundry detergent composition may be added to the laundry detergent enclosure through the enclosure aperture. In some embodiments, the laundry detergent enclosure is formed from a single piece of material.

The thickness of the walls of the capsule (e.g. the thickness of the capsule base, capsule lid and the side wall or side walls) is not particularly limited. Generally, the walls of the capsules described herein will include a water-soluble material. The thickness of such walls may be of a thickness to provide a structurally integral capsule and to allow an appropriate dissolution profile in use. The thickness of the capsule wall or walls may be 200 μm or more. In some embodiments, the thickness of the capsule wall or walls is 300 μm or more, 400 μm or more, 500 μm or more, or 600 μm or more. In some embodiments, the thickness of the capsule wall or walls is in the range of 0.2 to 5 mm. In some embodiments, the thickness of the capsule walls is in the range of 0.3 to 4 mm, 0.4 to 3.5 mm, 0.5 to 3 mm or 0.6 to 2.5 mm.

Capsule Lid and Capsule Base

The capsule of the present invention has a substantially planar capsule lid and a substantially planar capsule base. The substantially planar base allows the capsules to be laid in a substantially planar two dimensional array. The substantially planar lid allows the array of capsules to be packaged with minimal open space at the lid of the package.

In some embodiments, the plane of the capsule lid is substantially parallel to the plane of the capsule base. Such an arrangement allows for the capsules to be packaged in a substantially planar box.

The shape of the lid and base are not particularly limited. For example, the lid and/or base may be circular, elliptical, triangular, square, rectangular, rounded square, rounded rectangle, truncated circle, squircle, pentagonal or hexagonal in shape. In some embodiments, the shape of the capsule lid is selected from the group consisting of circular, elliptical, square, rectangular, rounded square, rounded rectangle, truncated circle and squircle. In some embodiments, the shape of the capsule base is selected from the group consisting of circular, elliptical, square, rectangular, rounded square, rounded rectangle, truncated circle and squircle. In other embodiments, the shape of the capsule lid and the capsule base is independently selected from the group consisting of circular, elliptical, square, rectangular, rounded square, rounded rectangle truncated circle and squircle. In particular embodiments the shape of the capsule lid and the capsule base are independently selected from the group consisting of rounded square, rounded rectangle, truncated circle and squircle. In some embodiments, the shape of the capsule lid is the same as the shape of the capsule base.

The shape of the sidewalls may be adapted to fit the shape of the capsule lid and capsule base such that the side walls connect the capsule lid with the capsule base to enclose a laundry detergent composition. The shape of the capsule may be cubic, cuboid, cylindrical or truncated conical.

Capsule Dimensions

The capsule of the present invention has a height of between 1.5 and 2.5 cm. The height allows the capsules to be packaged in a two-dimensional array of capsules with a height of less than 3.8 cm. Accordingly, the box of capsules can fit through a conventional mail slot. In some embodiments, the height of the capsule is in the range of 1.7 to 2.3 cm.

The capsule lid or capsule base has a lateral dimension of between 3.0 and 5.0 cm. In some embodiments, the lateral dimension is in the range of 4.0 to 4.8 cm.

Where the capsule lid or capsule base is a circle, the lateral dimension is the diameter of the circle. With other shapes, the shape typically has a width and a depth, and the lateral dimension is the longer of the width and depth. For example, the lateral dimension may be the length along the major axis of an ellipse. In particular embodiments, the capsule lid has a width and a depth and the width and depth are independently in the range of 3.0 and 5.0 cm, preferably in the range of 4.0 to 4.8 cm. Additionally or alternatively, the capsule base has a width and a depth, and the width and depth are independently in the range of 3.0 and 5.0 cm, preferably in the range of 4.0 to 4.8 cm.

In some embodiments, the capsule has an internal volume of in the range of 10 to 30 ml, 15 to 25 ml or 16 to 23 ml. Such an internal volume can house a single dose of laundry detergent composition.

Capsule Cavity

The capsule cavity is defined by the inner surfaces of the capsule base, capsule lid and the side wall or side walls. The laundry detergent composition is housed in the cavity of the laundry detergent capsule. The laundry detergent composition may occupy 70% or more, 75% or more, 80% or more, 85% or more, 90% or more, 95% or more or substantially all of the total volume of the internal cavity of the capsule.

In some embodiments, the internal cavity includes air. In other words, a portion of the volume of the internal cavity is occupied by the air. Namely, the capsule may contain some headspace. Such headspace (e.g. air in internal cavity of the capsule) may allow easier filling of the laundry detergent composition into the laundry detergent enclosure and easier sealing of the capsule lid onto the filled laundry detergent capsule. For example, including air as part of the volume of the cavity may avoid overfilling or spilling of laundry detergent composition when filling the laundry detergent enclosure, or before or during sealing the capsule. In some embodiments, air occupies 5% or less, 10% or less, 15% or less, 20% or less, 25% or less, or 30% or less of the total volume of the internal cavity of the capsule Capsule Surface Area In some embodiments, the total surface area of the exterior surfaces of the capsule is in the range of 60 to 90 $cm^2$. In some embodiments, the total surface area of the interior surfaces of the capsule is in the range of 55 to 85 $cm^2$, 60 to 80 $cm^2$ or 70 to 80 $cm^2$. The mass of capsule material used in each capsule may be in the range of 5 to 15 g.

In some embodiments, the ratio of total surface area of the exterior surfaces of the capsule to mass of capsule material is in the range of 90:5 (or 18:1) to 60:15 (or 4:1) $cm^2/g$. In this way, the capsule may have a relatively large exterior surface area for the amount of capsule material used. Such a configuration may provide a satisfactory dissolution rate of the capsule in use.

Laundry Detergent Composition

The water-soluble material forming the capsule encloses or contains a laundry detergent composition. In use, the water-soluble substrate may dissolve in water to release the laundry detergent composition enclosed within the capsule. Such laundry detergent compositions may be in solid, granular, gel or liquid form.

The amount of laundry detergent composition in each capsule may be in the range of 10 to 30 ml, 15 to 25 ml or 16 to 20 ml.

Capsule Material

The material of the capsule lid, capsule base and side wall or side walls is typically a water-soluble material. The exterior surface of the material is a surface that is intended to be exposed to the environment during use. The exterior surface typically opposes an interior surface intended to face or abut a laundry detergent composition to be contained, encased or enclosed in the capsule.

Suitable water-soluble materials are known. In particular, the water-soluble material may include one or more water-soluble polymers. In one embodiment, the water soluble material includes polyvinyl alcohol, a modified polyvinyl alcohol, polyvinyl acetate, polyacrylates, water soluble acrylate copolymers, polyaminopropyl sulfonic acid and salts thereof, polyitaconic acid and salts thereof, polyacrylamides, polyvinylpyrrolidone, pullalan, cellulosics (such as carboxymethylcellulose and hydroxypropyl methyl cellulose), water-soluble natural polymers (such as guar gum, xanthan gum, carrageenan and starch), water-soluble polymer derivatives (such as modified starches, including ethoxylated starch and hydroxylated propylstarch, poly(sodium acryloamido-2-methylpropane sulfonate, polymonomethylmaleate and salts thereof), copolymers thereof and combinations thereof. In some embodiments, the water soluble material includes, or consists essentially of, polyvinyl alcohol, a modified polyvinyl alcohol, polyvinyl acetate, carboxymethylcellulose or hydroxypropyl methyl cellulose.

In particular embodiments, the water-soluble material includes, or consists essentially of, polyvinyl alcohol, polyvinyl acetate and/or a modified polyvinyl alcohol. Polyvinyl alcohol, polyvinyl acetate and modified polyvinyl alcohols can provide stable water-soluble substrates that have suitable dissolution rates.

The water-soluble material may also contain one or more plasticizers. Examples of plasticizers include, but are not limited to glycerol, glycerin, diglycerin, ethylene glycol, diethylene glycol, triethylene glycol, tetraethylene glycol, monopropylene glycol, polyethylene glycol, neopentyl glycol, trimethylpropane polyether polyols, sorbitol, ethanolamines and mixtures thereof. The plasticizer, when present, may be included in the water-soluble material in an appropriate amount, as generally known.

In some embodiments, the water-soluble material includes a water-soluble polymer and a hygroscopic salt, the hygroscopic salt being present in the polymer material in an amount of at least 15% by weight based on the total weight of the polymer material. In some embodiments, the hygroscopic salt is an alkaline or alkaline earth metal salt. The hygroscopic salt may be an anhydrous or a hydrated alkaline or alkaline earth metal salt. In particular embodiments, the hygroscopic salt includes an anhydrous alkaline or alkaline earth metal salt. Examples of hygroscopic salts include, but are not limited to, sodium chloride, sodium citrate, calcium chloride, magnesium chloride, zinc chloride, potassium carbonate, potassium phosphate, carnallite, ferric ammonium citrate, potassium hydroxide, and sodium hydroxide. In some embodiments, the hygroscopic salt is selected from the group consisting of sodium chloride, sodium citrate, magnesium chloride and mixtures thereof. In particular embodiments, the hygroscopic salt is sodium chloride or sodium citrate.

The hygroscopic salt may be included in the water-soluble polymer material of the container in at least 15% by weight based on the total weight of the polymer material. In some embodiments, the hygroscopic salt is included in the water-soluble polymer material in an amount of 20% or more by weight based on the total weight of the polymer material. In particular embodiments, the hygroscopic salt is included in the water-soluble polymer material in an amount of 40% or more by weight based on the total weight of the water soluble polymer material. In further embodiments, the hygroscopic salt is included in the water-soluble polymer material in an amount of 50% or more by weight based on the total weight of the water soluble polymer material. The hygroscopic salt may be included in the water-soluble polymer material up to and including 75% by weight based on the total weight of the water soluble polymer material. In some embodiments the hygroscopic salt can be included in the water-soluble polymer material up to and including 70% by weight based on the total weight of the water soluble polymer material. In some embodiments the hygroscopic salt can be included in the water-soluble polymer material up to and including 65% by weight based on the total weight of the water soluble polymer material. Accordingly, the hygroscopic salt may be included in the water soluble polymer material of the container in the range of 15% to 75% by weight based on the total weight of the polymer material. In some embodiments, the hygroscopic salt is included in the water soluble polymer material of the container in the range of 40% to 70% by weight based on the total weight of the polymer material. In some embodiments, the hygroscopic salt is included in the water soluble polymer material of the container in the range of 50% to 65% by weight based on the total weight of the polymer material.

In some embodiments, the hygroscopic salt is micronized. In embodiments, the average particle diameter of the hygroscopic salt is less than 100 μm. In some embodiments, the average particle diameter of the hygroscopic salt is in the range of 0.03 to 75 μm. In particular embodiments, the hygroscopic salt has an average particle diameter in the range of 60 to 70 μm. In some embodiments, the hygroscopic salt has a coating layer. Such a coating layer may improve the salt particle properties. For example, the coating may act as an anti-caking agent. The hygroscopic salt coating layer may include sodium aluminosilicate, silicon dioxide and/or sodium hexacyanoferrate. In a particular embodiment, the coated hygroscopic salt is a sodium chloride particle coated with sodium aluminosilicate (E554), silicon dioxide (E551) and hexacyanoferrate.

In some embodiments, the material of the capsule lid, capsule base and side wall or side walls is an injection-moulded material. The material used to make these capsule components may be an injection-mouldable material. Injection moulding of the capsule components (e.g. the laundry detergent enclosure and the capsule lid) provides a simple process for manufacturing a plurality of capsule components (and thus capsules described herein) on a production line. In some embodiments, the material of the capsule lid, capsule base and side wall or side walls is a thermoformed material. Such injection moulded and/or thermoformed materials are known per se.

Strength of the Capsule

In some embodiments, the capsule as described herein may have sufficient strength to survive a drop from a height in the range of 1.0 to 1.5 metres. In these embodiments, the shape of the capsule lid and the capsule base may be independently selected from the group consisting of rounded square, rounded rectangle, truncated circle and squircle. In particular embodiments, the capsule includes the capsule lid and capsule base with substantially the same shape and size and the shape is selected from the group consisting of rounded square, rounded rectangle, truncated circle and squircle. Such capsules may provide sufficient strength to endure such a drop.

Box Containing Capsules

The present invention provides a box containing a two dimensional or linear array of laundry detergent capsules containing laundry detergent composition, the box having a height of no more than 3.5 cm. In some embodiments, the box contains a two dimensional array of laundry detergent capsules containing a laundry detergent composition, each capsule having a substantially planar lid and a substantially planar base, each capsule independently having a height in the range of 1.5 and 2.5 cm and each capsule lid or capsule base having a lateral dimension in the range of 3.0 and 5.0 cm.

The two-dimensional array as described herein typically means that the capsules are arranged in a configuration that extends at least two capsules wide, at least two capsules deep and no more than one capsule high. The linear array of capsules as described herein typically means that the capsules are arranged in a configuration that extends at least two capsules wide, no more than one capsules deep and no more than one capsule high.

Typically, the box will have a box base for receiving the capsules, box side walls to encase the capsule and a box lid to seal the capsules within the box.

The two dimensional array of capsules may include 12 to 30 capsules, preferably 16 to 24 capsules, more preferably 18 to 22 capsules.

The capsules may be arranged in the box in any configuration. The two dimensional array may be organised as a grid of capsules. Examples of grids of capsules includes, but are not limited to, grids of: 3 capsules wide and 4 capsules long (3×4); 3 capsules wide and 5 capsules long (3×5); 4 capsules wide and 4 capsules long (4×4); 3 capsules wide and 6 capsules long (3×6); 4 capsules wide and 5 capsules long (4×5); 4 capsules wide and 6 capsules long (4×6); 5 capsules wide and 5 capsules long (5×5); and 5 capsules wide and 6 capsules long (5×6). The box containing such a grid may have a square or rectangular box base and the box side walls may encase the grid of capsules.

When the box includes a linear array of capsules, the linear array may contain two or more, three or more, four or more, or five or more capsules in a line. In other words, the capsules are arranged in a line of 2, 3, 4, 5, 6 or more capsules long and one capsule deep or wide. The linear array may have 3 to 6 capsules, 3 to 5 capsules, or 3 or 4 capsules in a line.

The two dimensional array may alternatively be arranged in the box in another geometry such as concentric circles, a triangular, pentagonal pattern or a hexagonal pattern. The triangular formation may be arranged as an equilateral triangle (having, for example, 3, 6 or 10 capsules in the triangle), an isosceles triangle, a scalene triangle, as a right angle triangle, as an obtuse triangle or as an acute triangle. The box base and box sidewalls typically are adapted to encase such arrangements.

In some embodiments, no gap or a gap of less than 0.5 cm exists between the array of capsules and one of the box base, box lid or box side wall or walls. In particular embodiments, the gap is less than 0.2 cm. In some embodiments, no gap or a gap of less than 0.5 cm (preferably less than 0.2 cm) exists between the array of capsules and the base, the lid and the box side wall or at least one box side wall. Tight packing of the capsules in the box (namely, leaving a small or no gap between the array of capsules and the box) results in less movement of the capsules during transport, resulting in less chance of damage to the capsules.

The box may further contain one or more additional laundry items. For example, the box may also include a bottle of fabric conditioner and/or a bottle of care serum. Typically the one or more additional laundry items will have a height less than 3.5 cm to fit within the box. In some embodiments, one or more of the further laundry items will have a height in the range of 1.5 to 2.5 cm. When the box includes a bottle of fabric conditioner, the bottle of fabric conditioner may have contain 250 to 350 ml of fabric conditioner. The bottle of fabric conditioner may have a height of 1.5 to 2.5 cm, or 1.7 to 2.3 cm. The bottle of fabric conditioner may have a width of 15 to 20 cm, or 16 to 18 cm. The bottle of fabric conditioner may have a length of 7 to 12 cm, or 8 to 10 cm.

The box may be made of any conventional box material. Examples of box materials include, but are not limited to, cardboard, plastics, wood and reinforced paper. In some embodiments, the box is made of a recyclable material. In some embodiments, the box is made of recyclable cardboard.

In some embodiments, the box is made from a single piece of material folded into a box shape. The single-piece box may have a hinged lid. The box may have a sealing portion to seal the lid on the box. For example, the lid may have a sealing portion attached to a side wall of the box. The sealing portion may be attached to the box by known attachment means. For example, the sealing portion may be attached to the box by an adhesive or using staples or tacks. The sealing portion may include a quick release tab. The quick release tab may be a pull tab that detaches the lid from the side wall to allow the box to be opened. In some embodiments, the box includes a child-resistant opening.

The type of child-resistant opening is not particularly limited. For example, the child-resistant opening may require a significant initial force to begin opening the box such that a child would find it difficult to open the box.

Typically, the box of capsules may be able to withstand a drop from a height ranging from 1.0 to 1.5 metres without damage to the majority of capsules in the box. In some embodiments, the breakage rate after a drop from a height ranging from 1.0 to 1.5 metres is limited to 30% or less, 25% or less, 20% or less, 15% or less, 10% or less, 5% or less or none of the capsules in the box. Such a breakage rate may be measured by dropping a box of capsules from a height of 1.0 to 1.5 metres, noting the number of broken capsules in the box, repeating the test twice more with fresh boxes (with unbroken capsules) and averaging the rate of breakage from the three tests.

Method of Sending Laundry Detergent Capsules

The present invention also provides a method of sending laundry detergent capsules to a user. The method includes a step of sending a box to a user by a postal service, the box including a two dimensional array of laundry detergent capsules containing laundry detergent composition, the box having a height of no more than 3.5 cm.

Method of Producing Capsule

The capsule of the present invention can be manufactured using standard known techniques. For example, a water-soluble material may be formed (preferably thermos-formed) into a laundry detergent enclosure (e.g. capsule base and side wall or side walls). The cavity of the laundry detergent enclosure may then be filled with a laundry detergent composition, typically through the cavity aperture formed by the upper rim of the side wall or side walls. The laundry detergent enclosure containing the laundry detergent composition is then sealed by attaching the capsule lid.

In preferred embodiments, the capsule described herein is a rounded cuboid shape. In preferred embodiments, the capsule described herein has a height in the range of 1.8 to 2.2 cm and a lateral dimension in the range of 4.2 to 4.6 cm, optionally a width and/or depth in the range of 4.2 to 4.6 cm. In a preferred embodiment, the present invention provides a laundry detergent capsule containing a laundry detergent composition, the capsule having a substantially flat lid, a substantially flat base and one or more side walls extending from the capsule base to the capsule lid to form a capsule cavity housing the laundry detergent composition, the capsule having a height in the range of 1.8 and 2.2 cm and the capsule lid and capsule base each having a rounded square, truncated circle or squircle shape and each of the capsule lid and capsule base having a width in the range of 4.2 and 4.6 cm and a depth in the range of 4.2 and 4.6 cm.

Each optional feature described herein may be equally combined with another optional feature described herein. In particular, the optional features of the laundry detergent capsule may be an optional feature of one or more, or each laundry detergent capsule of the box containing a two-dimensional array of laundry detergent capsules and the method of sending such a box. Where there is a reference to a side wall or side walls and the capsule includes more than one side wall, the feature may apply to one or more side walls of the capsule. In particular embodiments, the feature may apply to all side walls of the capsule.

Turning to the Figures, FIG. 1 shows three shapes of capsule. In each capsule, the capsule base and capsule sidewall(s) may be made by thermoforming a material in a mould. The capsule lid may be thermoformed in a separate mould and attached to the capsule sidewall(s) after the laundry detergent composition is added to the cavity formed by the capsule base and capsule sidewall(s).

FIG. 1*a* shows a cylindrical capsule 1 with a circular capsule bottom, circular capsule lid 3 and a sidewall 5 extending between the capsule base and the capsule lid. The height is shown by h and the diameter of the capsule lid is shown by d. The diameter of the capsule base is also d.

Examples of dimensions of such cylindrical capsules are given below:

| Example | Diameter, d (cm) | Height, h (cm) |
|---|---|---|
| A | 3.4 | 2.20 |
| B | 3.6 | 1.97 |
| C | 3.8 | 1.76 |

Figure 1B:
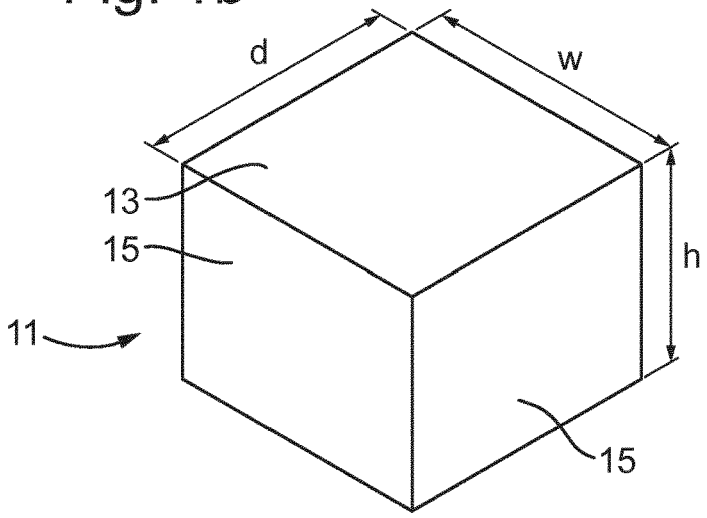

FIG. 1*b* shoes a cuboid capsule 11 with a square capsule bottom, square capsule lid 13 and four rectangular sidewalls 15 extending between the capsule base and the capsule lid 13. The height is shown by h, the width is shown by w and the depth is shown by d.

Examples of dimensions of such cuboid capsules are given below:

| Example | Width, w (cm) | Depth, d (cm) | Height, h (cm) |
|---|---|---|---|
| D | 3.01 | 3.01 | 2.20 |
| E | 3.19 | 3.19 | 1.97 |
| F | 3.37 | 3.37 | 1.76 |

Figure 1C:
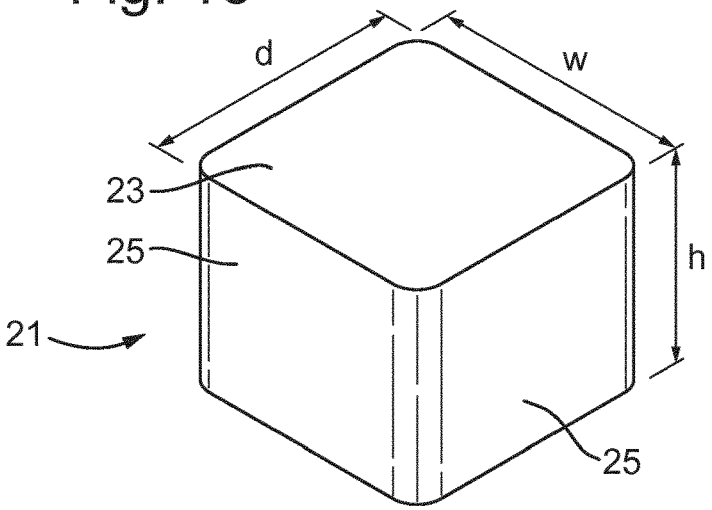

FIG. 1*c* shows a rounded cuboid capsule 21 with a rounded square capsule bottom, rounded square capsule lid 23 and four rounded rectangular sidewalls 25 extending between the capsule base and the capsule lid 23. The height is shown by h, the width is shown by w and the depth is shown by d.

Examples of dimensions of such rounded cuboid capsules are given below:

| Example | Width, w (cm) | Depth, d (cm) | Height, h (cm) |
|---|---|---|---|
| G | 3.01 | 3.01 | 2.20 |
| H | 3.19 | 3.19 | 1.97 |
| I | 3.37 | 3.37 | 1.76 |

A further example of a capsule of the present invention is a rounded cuboid capsule with Width=4.4 cm; Depth=4.4 cm and Height=2.0 cm.

Figure 2A:
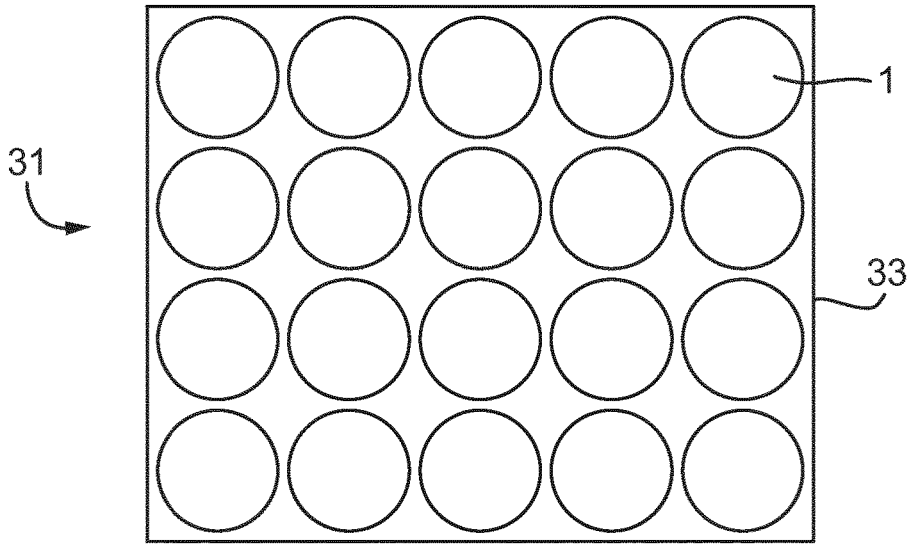
FIG. 2 shows plan views of two-dimension arrays of the capsules of FIG. 1.
Figure 2B:
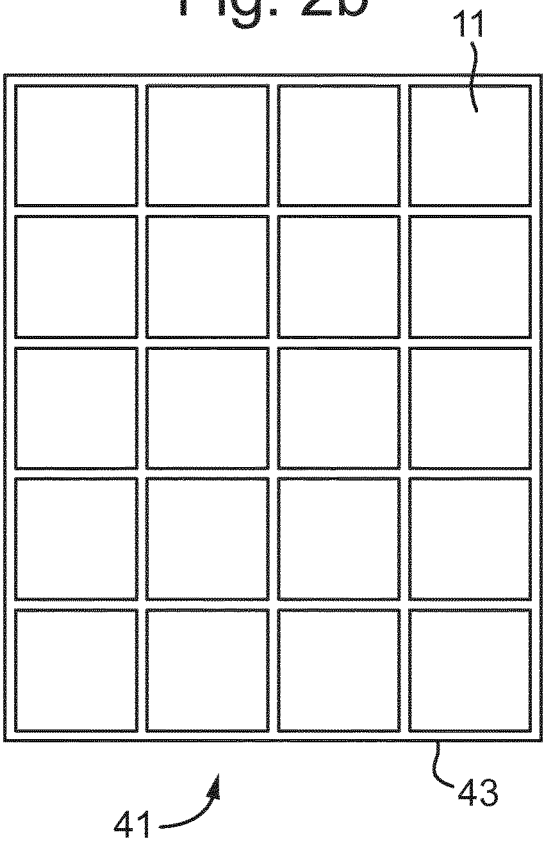
Figure 2C:
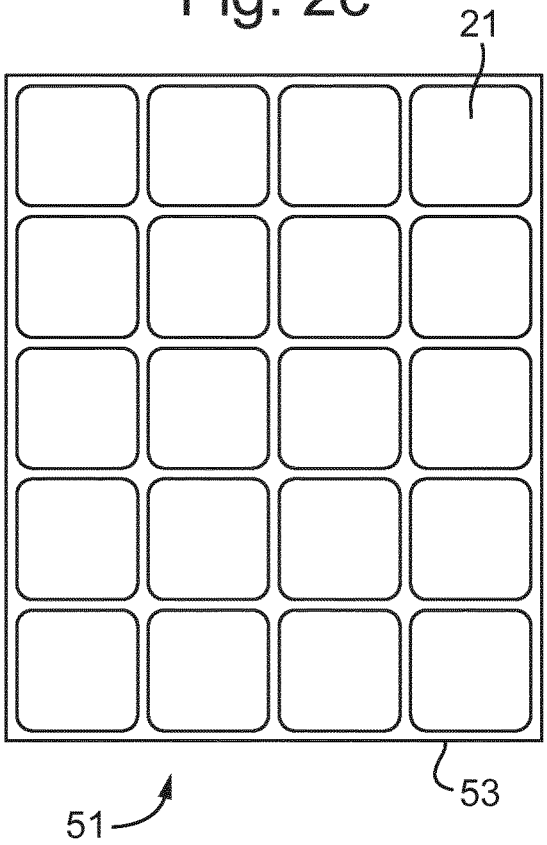

FIG. 2 shows a plan view of three boxes containing laundry detergent capsules. The box may be made of rigid cardboard to support and protect the capsules from a drop of around 1.2 metres.

FIG. 2*a* shows a box of capsules 31 including a grid of four cylindrical capsules of FIG. 1*a* wide and five cylindrical capsules of FIG. 1*a* in length encased by four cardboard box walls 33. Using the capsules with dimensions of Example C, the box dimensions may be 17 cm wide (accommodating four capsules along the width) and 19 cm long (accommodating five capsules along the length). Very little or no gap exists along the length between the box side wall and the array of capsules. About a total 1.8 cm of free space exists between each box side wall along the width of the box. In other words, there is 1.8 cm of the width of the box that is not occupied by the width of a capsule. FIG. 2*b* shows a box of capsules 41 including a grid of five cuboid capsules of FIG. 1*b* wide and four cuboid capsules of FIG. 1*b* in length encased by four cardboard box walls 43. Using the capsules with dimensions of Example F, the box dimensions may be 17 cm wide (accommodating five capsules along the width) and 13.5 cm long (accommodating four capsules along the length). About a total 0.15 cm of free space exists between each box side wall along the width of the box. In other words, there is 0.15 cm of the width of the box that is not occupied by the width of a capsule. About a total 0.02 cm of free space exists between each box side wall along the length of the box. In other words, there is 0.02 cm of the length of the box that is not occupied with the length of a capsule.

FIG. 3*b* shows a box of capsules 51 including a grid of five rounded cuboid capsules of FIG. 1*c* wide and four rounded cuboid capsules of FIG. 1*c* in length encased by four cardboard box walls 53. Using the capsules with dimensions of Example F, the box dimensions may be 17 cm wide (accommodating five capsules along the width) and 13.5 cm long (accommodating four capsules along the length). About a total 0.15 cm of free space exists between each box side wall along the width of the box. In other words, there is 0.15 cm of the width of the box that is not occupied by the width of a capsule. About a total 0.02 cm of free space exists between each box side wall along the length of the box. In other words, there is 0.02 cm of the length of the box that is not occupied with the length of a capsule.

The invention claimed is:

1. A box comprising a two-dimensional array of laundry detergent capsules containing a laundry detergent composition, the box having a height of no more than 3.5 cm, wherein each of the laundry detergent capsules containing the laundry detergent composition and having a substantially planar capsule lid and a substantially planar capsule base, the capsule having a height in the range of 1.5 and 2.5 cm and the capsule lid or capsule base having a lateral dimension in the range of 3.0 and 5.0 cm, wherein the capsule includes the capsule lid and capsule base with the same shape and size, wherein the shape is selected from the group consisting of rounded square, rounded rectangle, truncated circle and squircle, wherein the laundry detergent composition occupies at least 70% of the total volume of a cavity within the capsule, with any remaining volume being occupied by air, and wherein the capsule contains headspace formed by the air in the cavity of the capsule.

2. The box according to claim 1 wherein the capsule includes one or more side walls extending from the capsule base to the capsule lid.

3. The box according to claim 2 wherein the height of the capsule is in the range of 1.7 to 2.3 cm and/or the lateral dimension is in the range of 4.0 to 4.8 cm.

4. The box according to claim 2 wherein the laundry detergent composition occupies at least 75%, at least 80%, at least 85%, at least 90%, at least 95% of the total volume of a cavity within the capsule.

5. The box according to claim 2 wherein the capsule base, capsule lid and/or capsule side wall or side walls (if present) are made of a water-soluble material.

6. The box according to claim 1 wherein the plane of the capsule lid is substantially parallel to the plane of the capsule base.

7. The box according to claim 1 wherein the box is able to withstand a drop from a height ranging from 1.0 to 1.5 metres without damage to the majority of capsules in the box.

8. A method of sending laundry detergent capsules to a user wherein the method includes sending a box according to claim 1 to a user by a postal service.

* * * * *